US007997945B2

(12) United States Patent
Schmitz

(10) Patent No.: US 7,997,945 B2
(45) Date of Patent: Aug. 16, 2011

(54) FASTENING DEVICE FOR CONNECTING WEB

(75) Inventor: Frank Schmitz, Vettweiß (DE)

(73) Assignee: William Prym GmbH & Co. KG, Stolberg (DE)

( * ) Notice: Subject to any disclaimer, the term of this patent is extended or adjusted under 35 U.S.C. 154(b) by 278 days.

(21) Appl. No.: 12/223,019

(22) PCT Filed: Nov. 17, 2006

(86) PCT No.: PCT/EP2006/011040

§ 371 (c)(1),
(2), (4) Date: Jul. 18, 2008

(87) PCT Pub. No.: WO2007/087847

PCT Pub. Date: Aug. 9, 2007

(65) Prior Publication Data

US 2010/0144215 A1 Jun. 10, 2010

(30) Foreign Application Priority Data

Jan. 20, 2006 (DE) ..... 10 2006 002 778
Jun. 9, 2006 (DE) ..... 10 2006 026 823

(51) Int. Cl.
*H01R 11/22* (2006.01)

(52) U.S. Cl. ..... 439/816; 174/68.2

(58) Field of Classification Search ..... 439/212, 439/816, 775, 786; 174/68.2
See application file for complete search history.

(56) References Cited

U.S. PATENT DOCUMENTS

| | | | | |
|---|---|---|---|---|
| 3,124,403 | A * | 3/1964 | Rowe | 439/212 |
| 4,781,608 | A * | 11/1988 | Hillmann | 439/212 |
| 5,554,040 | A * | 9/1996 | Sugiura et al. | 439/212 |
| 6,875,923 | B2 * | 4/2005 | Egawa et al. | 174/68.2 |
| 7,713,086 | B2 * | 5/2010 | Schmitz | 439/567 |

FOREIGN PATENT DOCUMENTS

| | | |
|---|---|---|
| BE | 448 645 | 12/1943 |
| DE | 19 16 468 | 10/1970 |
| DE | 40 18 164 | 12/1991 |

* cited by examiner

*Primary Examiner* — Edwin A. Leon
*Assistant Examiner* — Vanessa Girardi
(74) *Attorney, Agent, or Firm* — Lucas & Mercanti, LLP; Klaus P. Stoffel

(57) ABSTRACT

The invention relates to a device (10.1) for connecting a web (25), comprising a pair of limbs (11, 12), the first two limb ends (13) being fixed to a support (30) while the remaining two limb ends (14) spring back and produce spring ends (14) for the purpose of connecting a web (25). In order to obtain a simpler and reliable connection, it is proposed that the two spring ends of the pair of limbs (11, 12) are connected to each other by means of a loop (20), the inside of the loop (24) serving to accommodate the web (25). When the web is connected, the loop (20) encompasses the cross section of the web and maintains it between its spring ends (14).

25 Claims, 12 Drawing Sheets

FASTENING DEVICE FOR CONNECTING WEB

BACKGROUND OF THE INVENTION

The invention pertains to a device for electrically or mechanically connecting a web. In a first field of application of this invention, the device is used to make electrical connections. In this case, the web is a current-carrying electrical conductor. In another field of application, the device is used as a fastener for a functional part.

Such a device is known from DE 19 16 468 A1. Here the pair of sidepieces consists of arc-shaped contact elements, the outer ends of which are supported against wall projections of a housing made of insulating material, whereas the inner ends of the elements are connected to each other by the integral U-shaped loop. To establish the desired contact, a plate, functioning as a plug-in element, is inserted into the loop. The end surface of the plate meets the bottom of the loop and carries the loop along until the two spring ends of the contact elements grip the plate between them. After contact has been established, the plate projects out of the opening of the loop, whereas the areas of the spring elements beyond an inflection point are deformed. The contacting force exerted on the plate by the contact elements then decreases somewhat, with the result that the plate retains itself in the loop.

BE 448 645 A shows a way in which wires can be attached to a piece of sheet metal, which can be either flat or bent into a hood-like shape. For this purpose, double-walled areas of the sheet are bent outward into flanges. An axial opening or a radial slot is formed between the double walls of the flanges, into which an electrical wire can be introduced.

SUMMARY OF THE INVENTION

The invention is based on the task of improving the device of the type indicated above in such a way that it becomes possible to connect a web in a more reliable manner either for the purpose of making electrical contact or for the purpose of fastening a functional part.

The web is pushed into the interior of the loop by a pressing means. The pressing means acts on the two spring ends of the pair of sidepieces and by the exertion of pressure narrows down the opening of the loop lying between the two spring ends behind the inserted web. What takes place is a crimping process, where the pressing means represents the active part of a crimping tool. The pair of sidepieces and the loop present between them represent the passive part of this crimping tool. After the crimping operation, the loop surrounds almost the entire circumference of the web present in the interior of the loop. After crimping, the opening of the loop is closed to such an extent that the web present in it can no longer escape. The pressing means of the crimping tool brings about the permanent deformation of the pair of sidepieces.

When the device is being used in its first application, i.e., as a device for establishing electrical contact, the web is a current-carrying electrical conductor, e.g., in the form of an uninsulated wire. When electrical contact is established, there is no damage to the wire. The large contact surface between the wire and the loop, which wraps almost completely around the wire, ensures a low transition resistance. The wire is held in place by the automatic retaining action of the loop. Through suitable selection of the material, of the surface condition of the clamping sidepieces, and of the shape of the loop, a wide range of variation is available for establishing electrical contact.

Additional measures and advantages of the invention can be derived from the subclaims, from the following description, and from the drawings. The drawings show several exemplary embodiments of the two applications of the invention mentioned above.

BRIEF DESCRIPTION OF THE DRAWINGS

FIGS. 1-6 show the use of the invention for making electrical contact, whereas

FIG. 1 shows part of a bus bar, on which a plurality of inventively designed pairs of clamping sidepieces is arranged;

FIG. 2, on an enlarged scale, shows a pair of clamping sidepieces on the bus bar of FIG. 1 in the resting state, in which the wire is still outside the loop;

FIG. 3 shows a view similar to that of FIG. 2, except that contact has now been established, the wire having been introduced into the loop;

FIG. 4 shows a perspective view of the contact state illustrated in FIG. 3;

FIG. 5, in a view similar to that of FIG. 3, shows a first variant of the device functioning as an electrical connector, this device having been provided with a thrust pad;

FIG. 6 shows a second variant of the device according to FIG. 3, where a latching connecting is provided between the loop and the resilient pad;

FIG. 7 shows a plan view of a device for use as a fastener, namely, in a resting state similar to that of FIG. 2;

FIG. 8, in a view analogous to that of FIG. 3, shows the fastener of FIG. 7 after the connection has been established, where the web of a functional part is anchored in the loop;

FIG. 9 shows a preliminary stage of the production of a functional part for FIG. 8 in the form of a plate with edges, which are to be bent over in the next step of the process, where several semi-finished products are stamped out from a metal strip and then merely separated and bent over at the edges;

FIG. 10 shows a perspective view of two cooperating plate-shaped housing parts according to the prior art, which are replaced according to the invention by a fastener according to FIG. 7 and a by functional part according to FIGS. 8 and 9;

FIG. 11 shows a perspective view of a shield housing according to the prior art formed out of the two housing parts of FIG. 10.

DETAILED DESCRIPTION OF THE INVENTION

Figure 1:
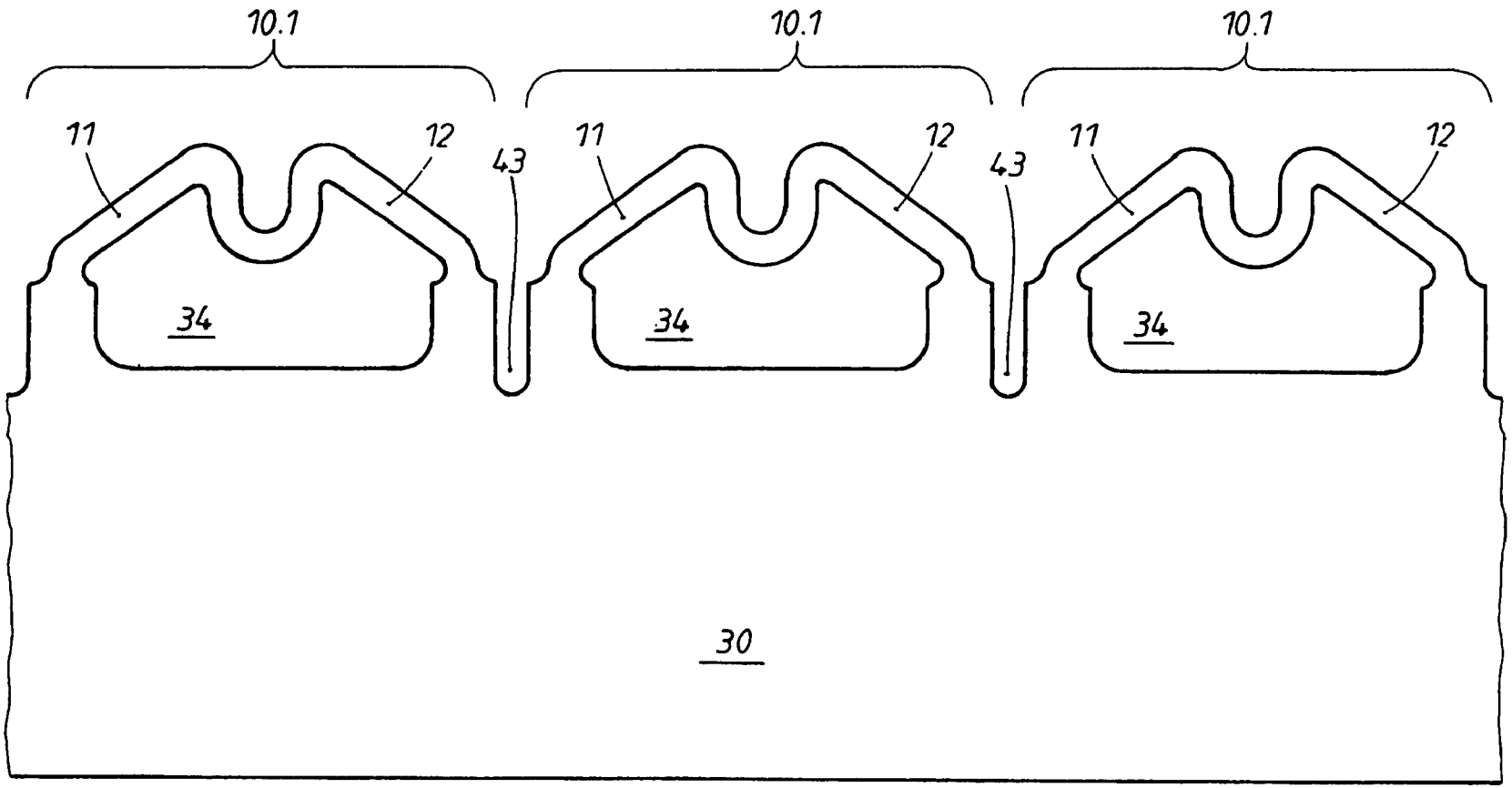

As said above, FIGS. 1-6 deal with a first application of the inventive device, in which it is used to establish an electrical connection with a current-carrying wire. FIGS. 1-4 show a first exemplary embodiment 10.1. Here several devices 10.1 are arranged at the edge of a bus bar 30. A voltage is present during operation. As can best be seen in FIG. 2, the fixed ends 13 of the clamping sidepieces 11, 12 are seated on the two arms 31, 32 extending from the bus bar 30. The end 13 of the sidepiece is referred to in brief in the following as the "fixed end". The other ends 14 of the clamping sidepieces are designed to move elastically with respect to each other and are therefore called the "spring ends". The spring ends 14 of the two clamping sidepieces 11, 12 are connected to each other by a loop 20.

Figure 2:
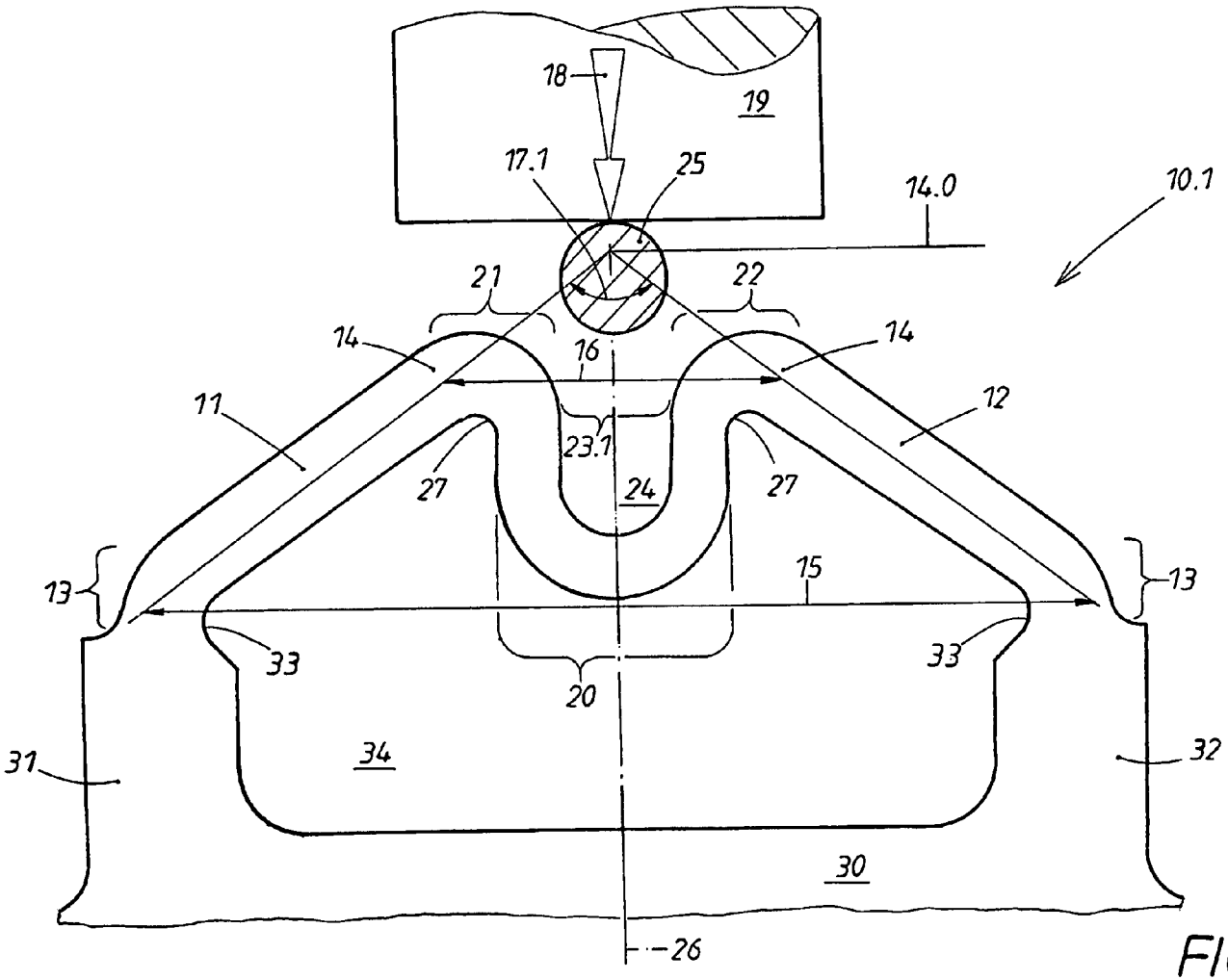

The loop 20 has essentially the shape of a "U" and merges with the two spring ends 14 by way of two S-shaped transitions 21, 22, which curve in opposite directions. The distance 15 between the two fixed ends 13 is much larger than the distance 16 between the two spring ends 14. As a result, the two clamping sidepieces 11, 12 form an angle with each other. The clamping sidepieces 11, 12 are essentially linear, and when at rest they enclose an angle 17.1 in the area of their spring ends 14; in the exemplary embodiment shown here, this angle is approximately 110°. The two clamping sidepieces 11, 12 slant toward each other with mirror symmetry. The plane of symmetry 26 between the two sidepieces 11, 12 is shown in FIG. 2 in dash-dot line. The auxiliary line in FIG. 2 shows the rest position 14.0 of the two clamping sidepieces 11, 12, i.e., the position which is present when the wire 25 is still outside the loop 20.

As can also be seen in FIG. 2, the web to be connected consists here of an electrical conductor in the form of an uninsulated wire 25. The wire 25 is brought into the area of the opening 23.1 of the loop 20 and then, by the exertion of pressure by means of a pushing tool 19, is introduced into the interior of the loop 24. The direction in which the wire 25 is introduced is illustrated by the thrust arrow 18 in FIG. 2 and lies in the plane of symmetry 26, which bisects the angle 17.1 between the two clamping sidepieces 11, 12. The result of introducing the wire can be seen in FIG. 3.

Figure 3:
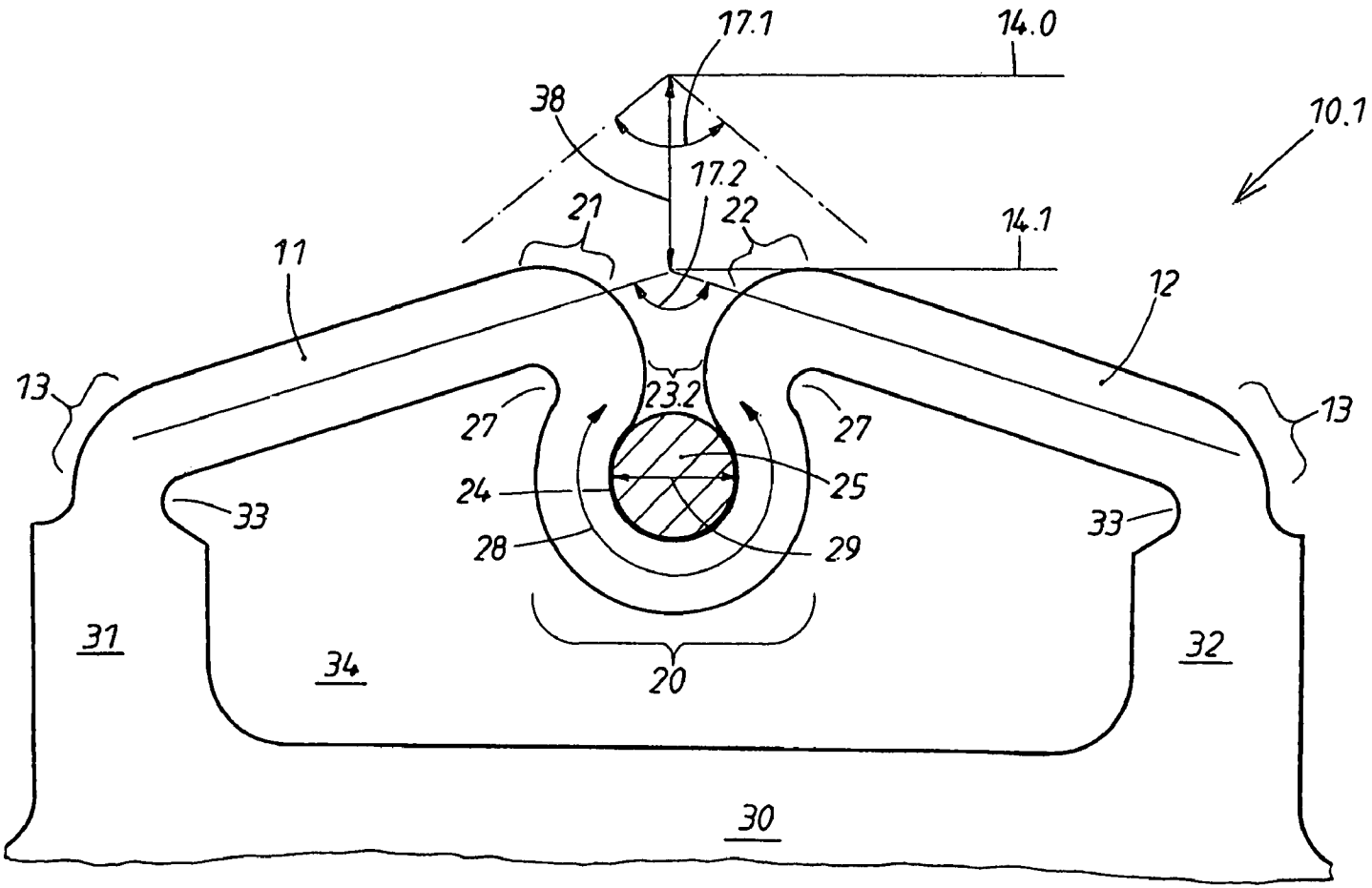
Figure 4:
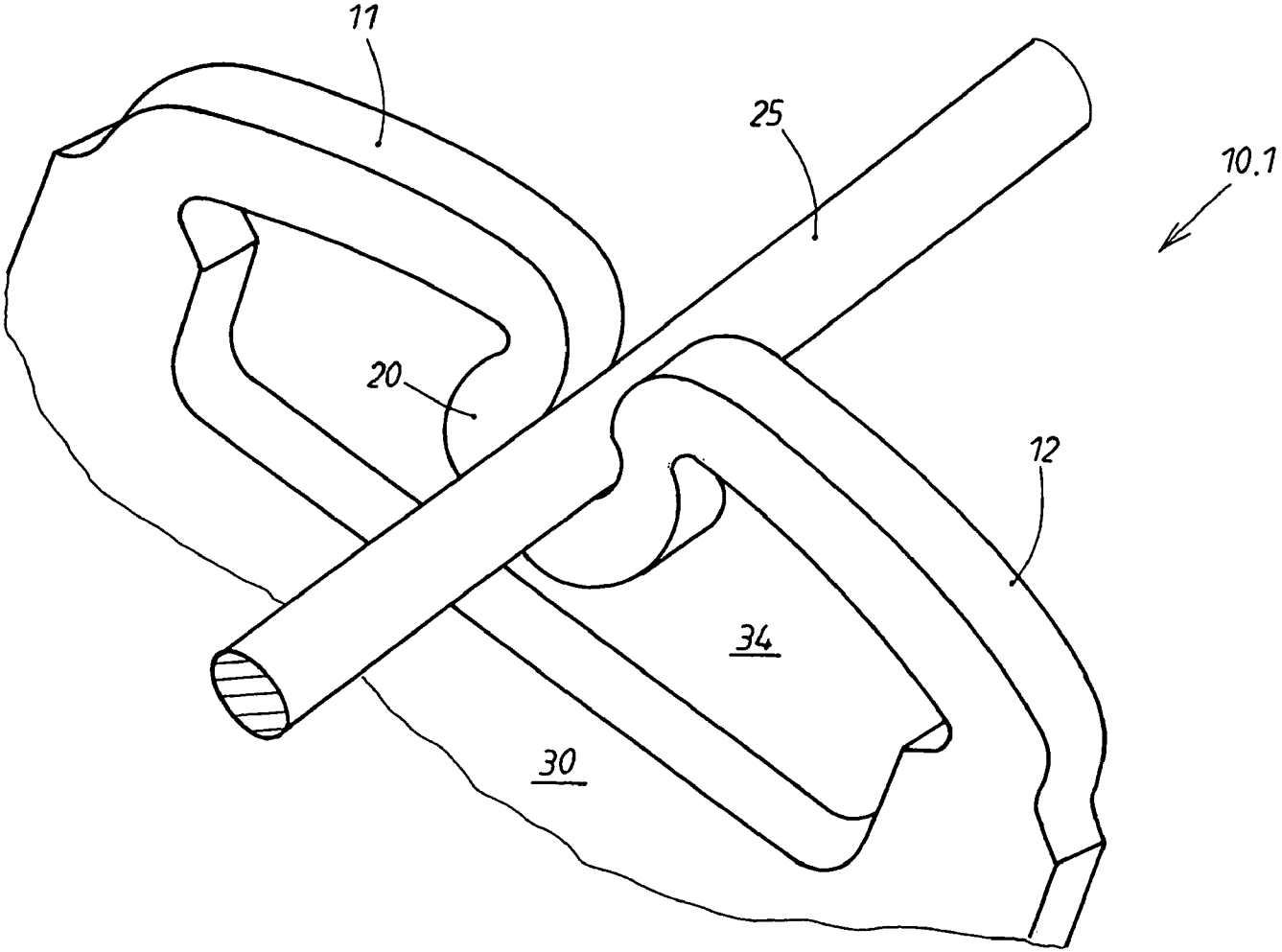

When we compare the contact state of FIG. 3 with the resting state of FIG. 1, we see that the profile defining the inventive device 10.1 has been deformed in several ways. The two clamping sidepieces 11, 12 now slant much more directly toward each other and enclose a larger angle 17.2 between them. In FIG. 3, the spring ends of the two clamping sidepieces 11, 12 are located in a crimped state marked by the auxiliary line 14.1. The corresponding resting position 14.0 of FIG. 2, however, is also shown in dash-dot line in FIG. 3. When, proceeding from the state shown in FIG. 2, the wire 25 is moved into its crimped state shown in FIG. 3, the spring ends of the clamping sidepieces are pressed toward each other by a compression distance 38. In FIG. 3, not only the S-curves 27 have become more sharply curved at the two transitions 21, 22 but also the bending points 33 have become deformed, namely, the points present between the fixed ends 13 and the two arms 31, 32 of the bus bar 30.

The shape of the loop 20 has also changed considerably in the crimped state of FIG. 3. The original U-shape has become an upside-down O-shape. The loop opening 23.2 in the crimped state of FIG. 3 is smaller than the opening 23.1 present in the resting state of FIG. 2. The open width of the loop opening has become smaller. The loop encompasses a larger circumferential area 28 of the introduced wire 25; the loop can extend around as much as 315°. Because the open width 23.2 is smaller than the diameter 29 of the wire 25, the wire 25 could even be said to retain itself in the interior 24 of the loop 20 when in the crimped state. It is no longer possible for the wire 25 to escape from the device 10.1.

The deformation of the loop 20 which occurs on transition from the resting position 14.0 of FIG. 2 to the crimped state 14.1 of FIG. 3 can be described as a "crimping" of the loop. The pair of sidepieces 11, 12 acts as the first part of a two-part crimping tool, which passively participates in the previously described pressure 18 of FIG. 2, which is exerted on the two spring ends 14. The second, active part of the crimping tool is a pressing means 19, which exerts the described pressure 18 on the two sidepieces 11, 12. For this reason, it is possible to consider the pair of sidepieces 11, 12 as the "passive part" of this two-part "crimping tool". The upper part of the device 10.1 is a combination of a crimping element, namely, the loop 20, and a crimping tool, namely, the pair of sidepieces 11, 12, which are integrally connected to the loop 20. Because of the crimping-and-control function of the sidepieces 11, 12 in the area of the loop 20, the active crimping tool needed to complete the tool system, namely, the pressing means 19, can be of very simple design, e.g., a hammer or a pushing tool.

The inventive device 10.1, as previously mentioned, is designed as an integral part of the bus bar 30. It is made simply by stamping out a hollow profile 34 and the intermediate notches 43 in the edge zone of the plate-shaped bus bar 30, as can be seen most clearly in FIG. 1. In the crimped state of FIG. 3, the spring-like elasticity of the material provides a clamping force, which acts on the wire 25 and tries to reverse the previously described bending at the bending points 33, 27 and the deformations in the area of the loop 20. The result is that the large areas of the loop and of the circumference of the wire 25 are pressed against each other.

Figure 5:
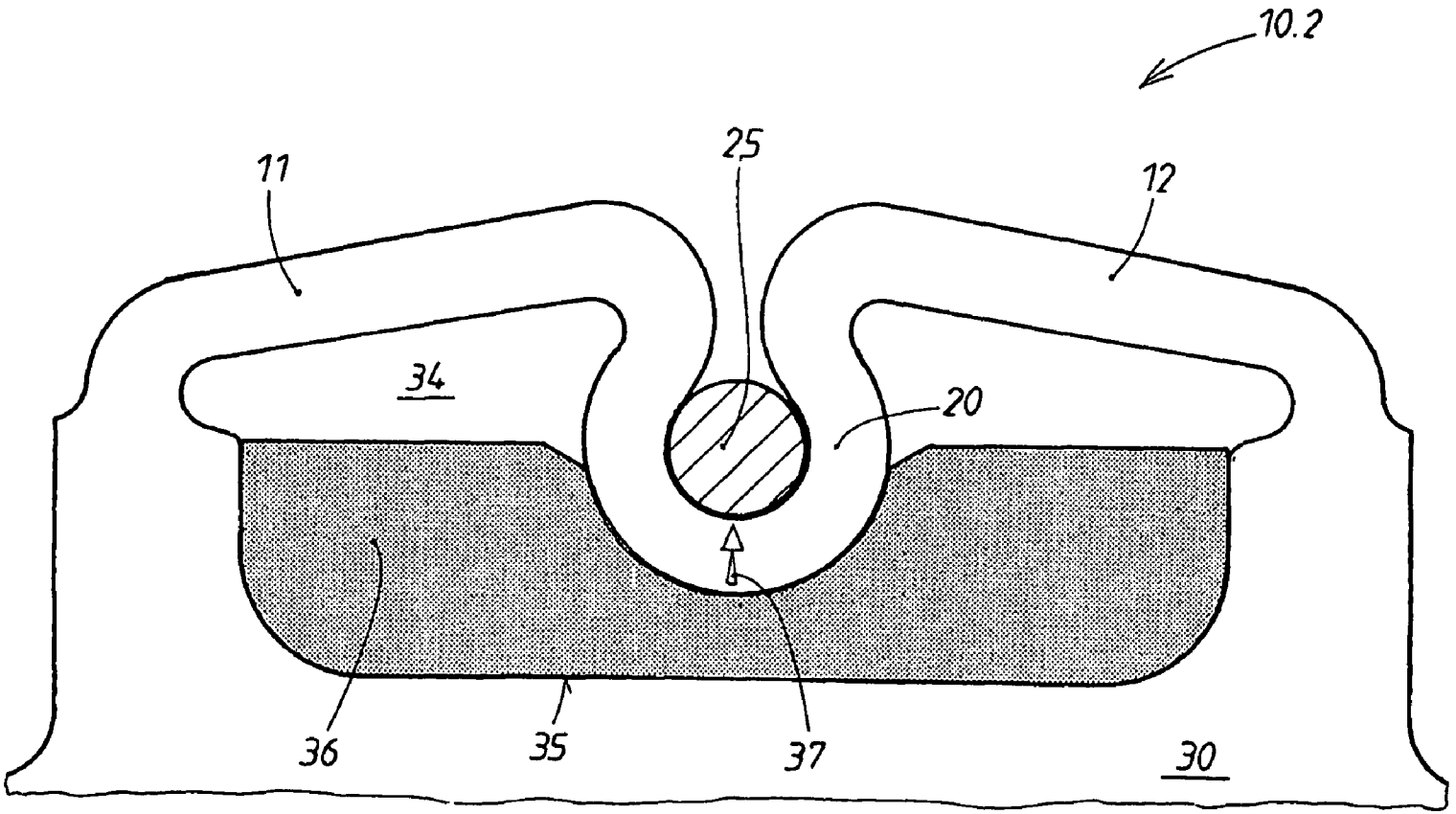
Figure 6:
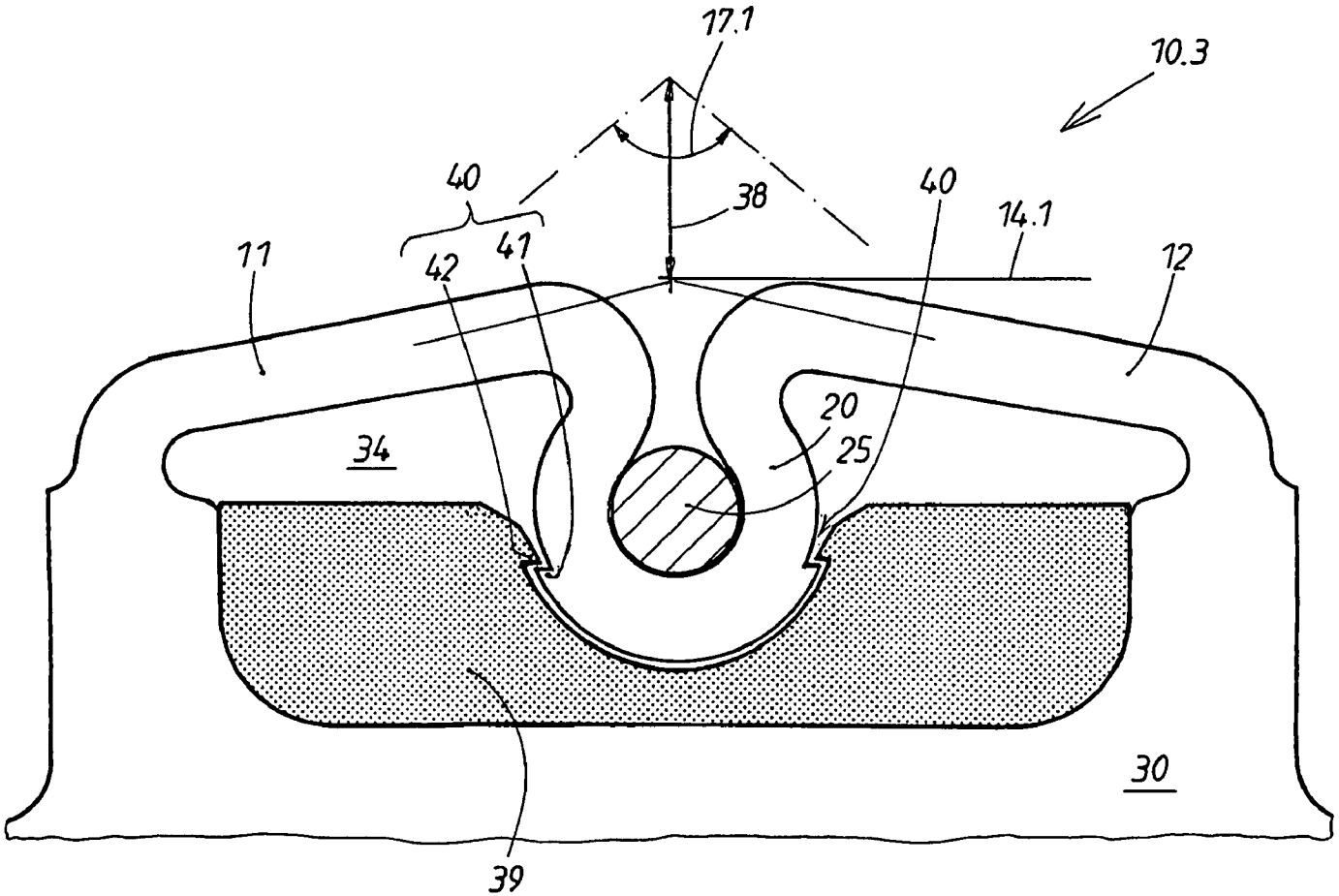

FIGS. 5 and 6 show two additional variants 10.2 and 10.3 of the inventive device. The reference numbers used to designate the parts here are the same as those used for the first exemplary embodiment 10.1, and to that extent the previous description also applies here. Only the differences need to be discussed.

The difference in FIG. 5 is that a thrust pad 36 of elastomeric material is provided in the bottom area 35 of the stamped-out opening 34. When the crimped state shown in FIG. 5 is present, the loop 20 is pressed against the thrust pad 36, which leads to additional deformation of the loop 20. The deformation of the thrust pad 36 leads to the generation of a restoring force by the thrust pad 36, illustrated by an arrow 37, which has the effect of increasing the force pressing the loop and the wire 25 held in it against each other. As a result, the electrical contact produced in the device 10.2 is improved.

In the variant 10.3 of FIG. 6, the special feature is that at least one latching connection 40 is provided, which additionally secures the crimped state of the two clamping sidepieces 11, 12 and increases the force being exerted on the circumferential area of the wire 25 even more. In the present case, the latching connection 40 is double-sided, consisting of a latching projection 41 on the circumference of the loop 20 and a stationary opposing latching element 42. The latching projection 41, as in the present case 10.3, can be integrated into the circumferential profile of the loop 20. Another possibility is to design the latching projection 41 as a separate part and to attach it to the loop 20. The key point in the case of the device 10.3 of FIG. 6, however, is that, during the compressive movement 38 of the clamping sidepieces 11, 12 already described in conjunction with FIG. 3, the latching projection 41 must move along with the loop 20.

The opposing latching element 42 consists of an undercut, which, as also shown in FIG. 6, is incorporated into a resilient pad 39 in the stamped-out opening 34. This resilient pad 39 can supplementally provide the restoring force 37, which were described in conjunction with the thrust pad 36 of the device 10.2 of FIG. 5. The crucial point in any case, however, is that, during the compressive movement 38, an interaction takes place, during which the opposing latching element 42 and/or the latching projection 41 become elastically deformed until the crimped state 14.1 of FIG. 6 occurs and the latching projection 41 grips under the opposing latching element 42. Then the wire 25 is secured in the interior of the loop 20. Optimal contact is achieved between the wire 25 and the device 10.3. The difference between the thrust pad 36 and the resilient pad 39 is that the resilient pad 39 has the latching element 42.

Figure 7:
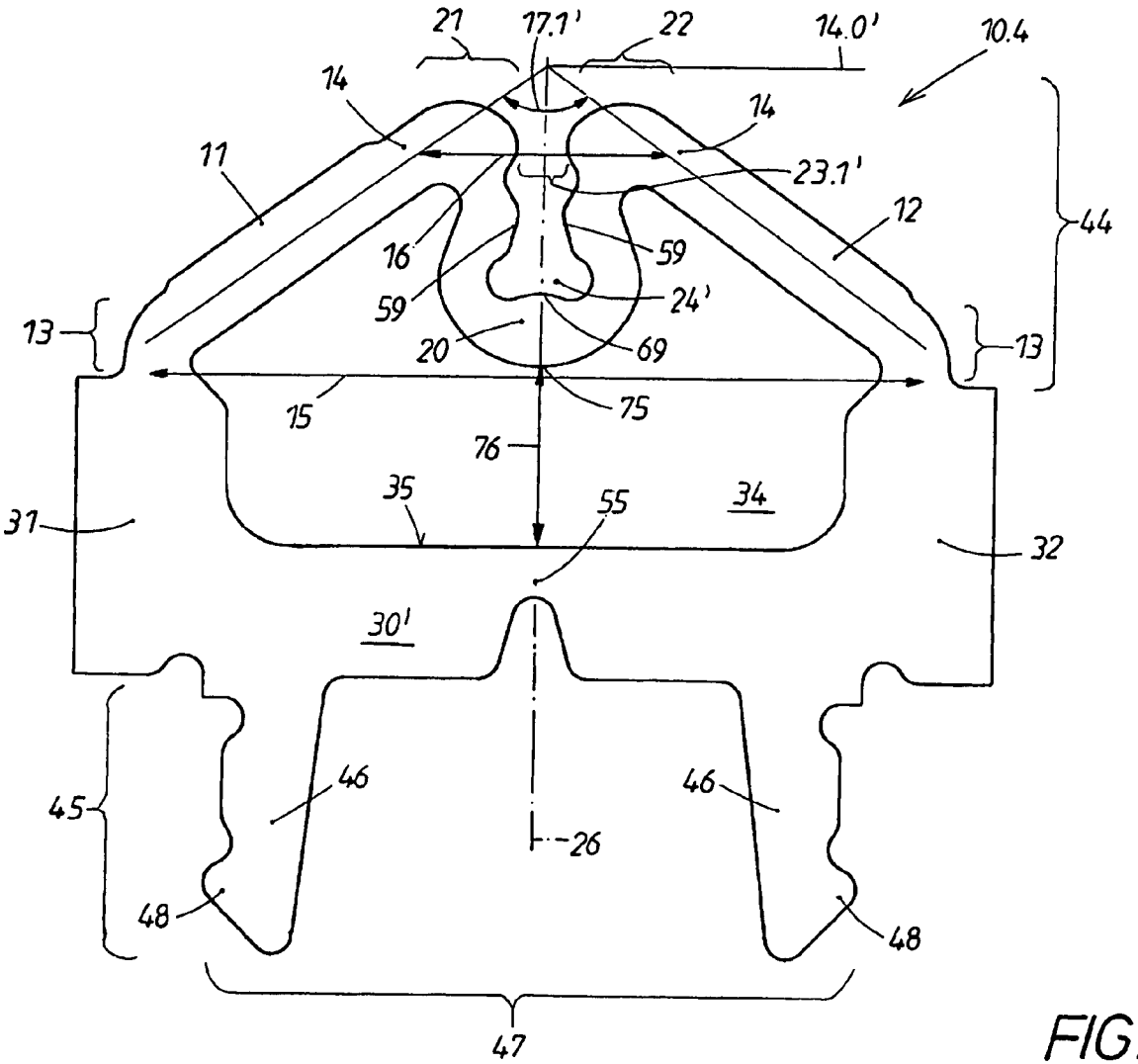
FIGS. 7-11 show the use of the invention for fastening an electrical functional part.
Figure 8:
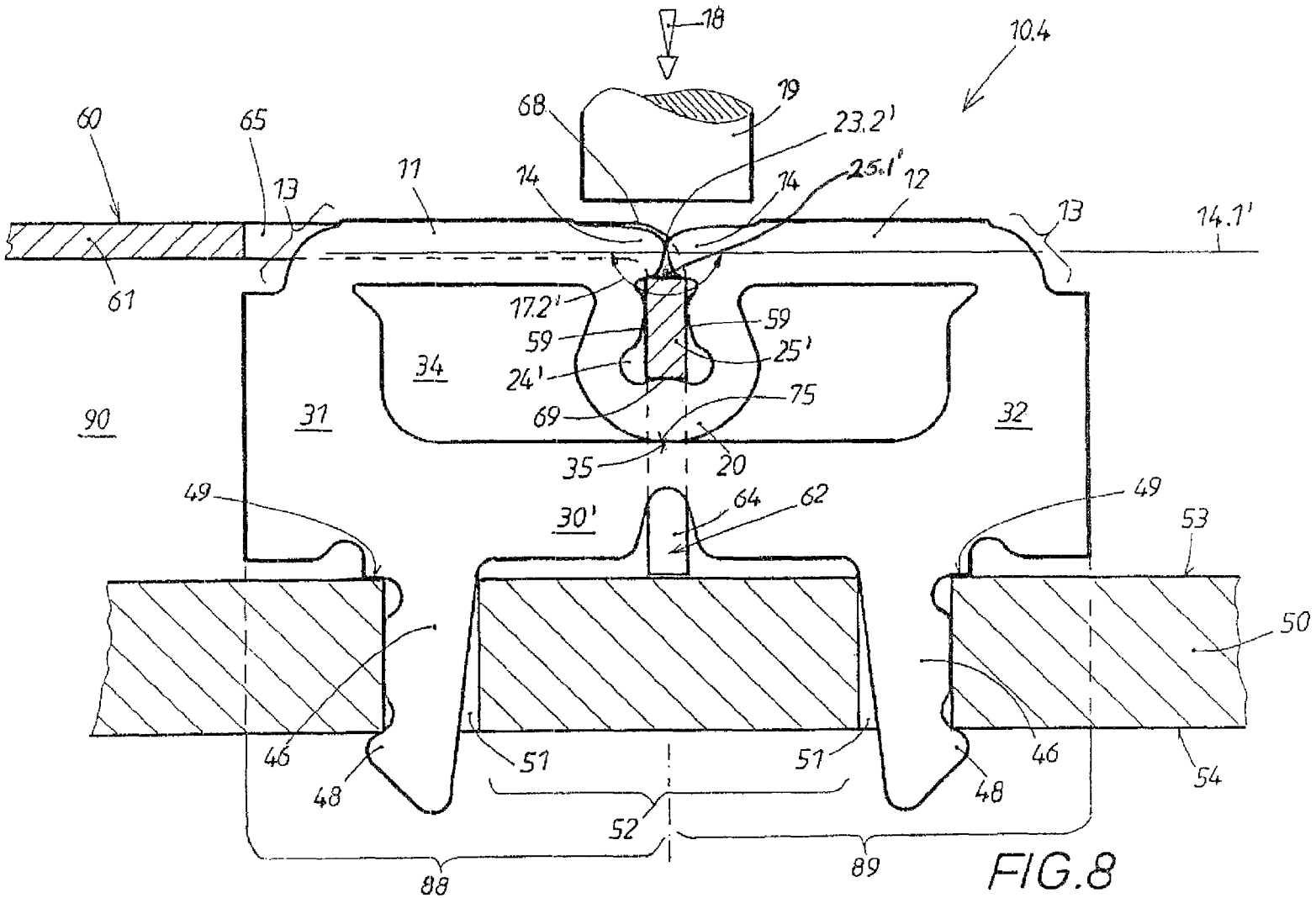
Figure 9:
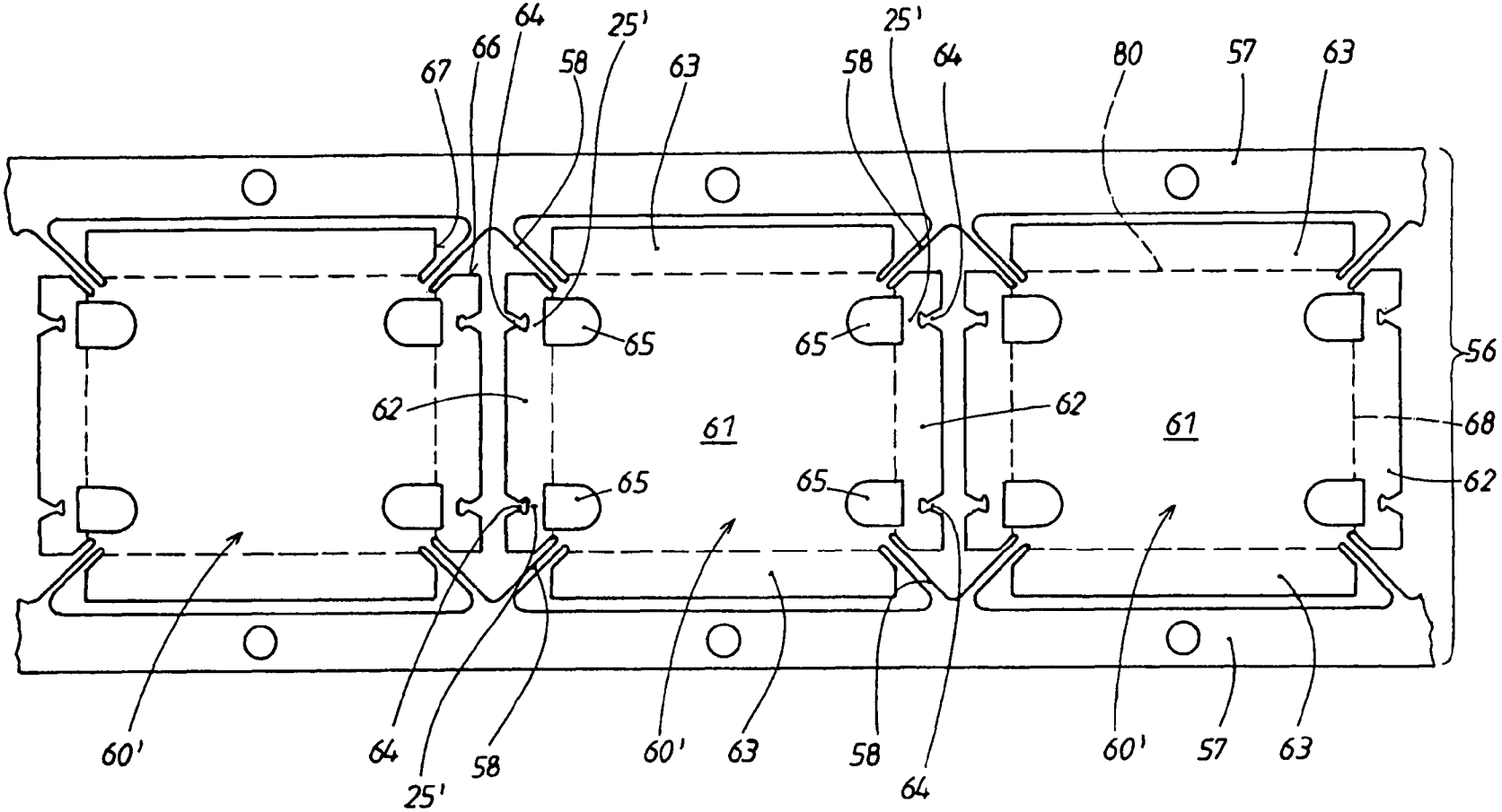

As previously mentioned, FIGS. 7-9 illustrate an application of the inventive device 10.4 as a fastener for a functional part 60, which can be seen in FIG. 8. This fastener 10.4 is largely the same as the electrical connecting device 10.1 of FIGS. 1-4. For this reason, the reference numbers and terms used there also apply to FIGS. 7 and 8 for the fastener 10.4. To that extent the previous description also applies here. It is sufficient to discuss only the differences.

The fastener 10.4 is a stamped product consisting of sheet metal and can be divided into three pieces 44, 30', 45. On the central piece 30' of the stamped product there is a head piece 44 with a design similar to that of the device 10.1 of FIGS. 2 and 3. In the lower area of the central piece 30' there is also a foot piece 45, which is used to attach the fastener 10.4 to a base 50, shown in FIG. 8. The base 50 in the present case consists of a circuit board with several through-holes 51. Because a pair 47 of latching arms 46, which forms the previously mentioned foot piece 45, is used as the means of attachment for the fastener 10.4, a pair 52 of these through-holes 51 is assigned to each pair of arms. As can be seen in FIG. 7, not only the previously described head piece 44 but also all the rest of the fastener 10.4, that is the central piece 30' and the foot piece 45, are designed with mirror symmetry to the plane 26 shown in dash-dot line in FIG. 7.

The central piece 30' is a strip, which, during use as shown in FIG. 8, is essentially parallel to the top side 53 of the circuit board 50. To attach it, the latching arm pair 47 is pushed into the associated pair 52 of through-holes 51 until the latching projections 48 on the free ends of the latching arms 46 emerge from the bottom side 54 of the base 50 and grip the circuit board at the edge of the associated through-holes 51. Thus the fastener 10.4 is attached to the circuit board 50. The central piece 30' has support edges 49, which, after the piece has been attached as shown in FIG. 8, rest on the top side 53 of the circuit board 50. Through suitable profiling and arrangement of the latching arm pair 47 and the through-hole pair 52, the fastener 10.4 can be attached to the circuit board 50 without play.

To attach the fastener 10.4 to the circuit board 50, the two latching arms 46 must be temporarily bent elastically toward each other as they are being threaded through the two holes 51, so that, afterwards, as described above, the latching projections 48 can establish their grip. This is made possible by tapered cutouts in the central piece 30' at the points where the two latching arms 46 are attached. Thus better advantage can be taken of the springiness of the fastener material. In addition, the central piece 30' has a bending point 55 created by a notch, which merges with the foot piece 45. During the attachment procedure described above, this bending point 55 makes it easier for the two latching projections 48 to move toward each other as they pass through the through-holes 51.

In the case of the fastener 10.4 as well, the head piece 44 is used for the connection of a web 25' as shown in FIG. 8. This is accomplished in similar fashion by using a pushing tool 19 to exert pressure 18, as described for the wire 25 of the first exemplary embodiment according to FIGS. 1-4. In the case of the fastener 10.4 as well, a "crimping" operation takes place in the area of the loop 20, as already described in conjunction with the first exemplary embodiment of the device 10.1. The head piece 44 of the fastener 10.4 again has a double function, namely, the function of providing a crimping element in the area of the loop 20 and the function of providing a passive part of the "crimping tool" in the area of the two sidepieces 11, 12. This passive crimping tool acts together with the active part of the crimping tool shown in FIG. 8, namely, a pushing tool 19 or the like.

In the present case, the web 25' is a component of a housing 60, which is intended to cover electrical components (not shown) mounted on the circuit board 50. The housing 60 consists of a cover plate 61, which, because of its good thermal conductivity, is also intended to dissipate the heat of the electrical components mounted inside the housing. The form of the housing 60 can be described most clearly on the basis of FIGS. 8 and 9.

FIG. 9 shows a strip of material 56, in which a continuous array of semi-finished products 60' have been stamped out, from which the housings 60 themselves are then produced by separating and bending. Part of one of these housings is shown in FIG. 8. The semi-finished products 60' are stamped out from the strip material 56 section by section and remain connected to the edge strips 57 of the metal strip 56 by metal bridges 58, which are to be separated later. The later form of the housing 60, which is to be used as a shield housing on the circuit board 50, can already be seen even from the semi-finished product 60'.

What is later to become the housing 60 has, roughly speaking, the form of a shell, which is inverted for use. It can be divided into an essentially flat cover plate 61, which is formed by the middle area of the stamped semi-finished product 60' shown in FIG. 9, and the strips around the edges. The edge strips 62, 63 surrounding the cover plate 61 in the semi-finished product 60' are bent over at a right angle in the next step of the process. Thus the edges 66, 67 of the bent-over edge strips 62, 63 come in contact with each other. After they have been bent, the two edge strips 62, 63 have the similar function of forming the side walls of the finished housing 60. This can be seen to a partial extent in FIG. 8. In addition, the one edge strip 62 also has the function of forming plate webs 25'.

For this purpose, holes 65 are stamped out in the stamped semi-finished product 60' at the transitions between the cover plate 61 and what is later to become the edge strips 62. One or two holes 65 in the transition area between the cover plate and the adjacent edge strips 62 are sufficient. The edge strips 62 are also provided with edge notches 64, which are aligned with the holes 65, so that, between them, the previously mentioned plate webs 25' are created. As FIG. 8 makes clear, the plate webs 25' start just below the bent edge 68 between the cover plate 61 and the edge strip 62. Because these webs 25' are formed out of the strip material of the housing 60, they are rectangular in shape.

As previously mentioned, the fasteners 10.4 have the task, when in use, of attaching the housing 60 to the circuit board 50. This is done by forming the previously mentioned plate webs 25' in the plate material of the housing; when the attachment operation is to be performed, these webs are then introduced into the interiors 24' of the loops shown in FIG. 8 in the following special manner.

In the case of the fastener 10.4, the interior 24' of the loop does not have a smooth U-shape even in the resting state 14.0' of FIG. 7. On the contrary, it is profiled. It has opposing lateral protrusions 59 and another elevation 69 at the bottom. The function of these protrusions 59 and elevations 69 can be seen in FIG. 8, which shows the crimped state 14.1'. There, as previously mentioned, the pair of sidepieces 11, 12 is pressed together by a tool 19 to such an extent that the angle 17.1' of FIG. 7 is stretched open. An angle 17.2' of about 180° is formed. The squeezing-together of the spring ends of the two sidepieces 11, 12 can be limited by the contact of the crown 75 of the loop 20 with the bottom area 35 of the stamped-out hole 34 previously described on the basis of the first exemplary embodiment. As the two spring ends 14 undergo the flattening process, these ends can, as shown in FIG. 8, arrive in contact with each other as shown at zero opening 23.2' of FIG. 8 and thus close off the loop opening 23.1', which previously existed between them as shown in FIG. 7. In the resting state 14.0' of FIG. 7, the loop opening 23.1' is large enough to allow the introduction of the plate web 25'. In FIG. 7, furthermore, the crown 75 of the loop is still a considerable distance 76 away from the bottom area 35 of the stamped-out hole 34.

In the crimped state 14.1 of FIG. 8, the plate web 25' is captured in the interior 24' of the loop. That is, a material which is held in place in the flattened position of the sidepiece ends 14 by the protrusions 59 and elevation 69 is used for the fastener 10.4. The two lateral protrusions 59 in the interior 24' of the loop are pressed from opposite sides against the flat profile of the plate web 25', whereas the outer end surface of the plate web 25 is supported against the elevation 69 at the bottom. As FIG. 8 also shows, the inner boundary of the plate web 25', i.e., the top narrow side 25.1' which faces the hole 65 in the plate, serves as a contact surface for the flat-pressed sidepiece ends 14. When the fastener 10.4 is in the crimped state 14.1 of FIG. 8, the plate web 25' is held in place without play in the interior 24' of the loop.

As FIG. 9 illustrates, the inventive housing 60 is formed by a two-fold bending operation. That is, the transverse edge strip 62 is bent at the previously mentioned first bending edge 68 versus the cover plate 61, and the longitudinal edge strip 63 is also bent in similar fashion. Thus a second bending edge 80 is also present, as can be seen in FIG. 9. By bending over the edge strips 62, 63, the previously mentioned one-piece housing 60, which can be attached to the circuit board 50 by means of four fasteners 10.4 in the previously described manner as illustrated in FIG. 8, is obtained from the stamped semi-finished product 60' of FIG. 9. The housing 60 uses less material than that of the prior art according to FIGS. 10 and 11, as will be described below, and it is also of simpler design, which means that it can be manufactured more quickly and installed more easily.

Although the fastener 10.4 is separate from the housing 60, it is characterized by universal applicability. The inventive fastener 10.4 can be used as a means for connecting functional parts of any type to a base 50. For example, it is possible to mount housings 60 of larger or smaller design to a base 50 by means of the same fastener 10.4. The connection between the base 50 and the fastener 10.4 can also be established by means other than the pair 47 of latching arms described above.

As previously mentioned, a shield housing according to the prior art is more complicated than the invention, uses more material, and is more difficult to mount. This can be illustrated on the basis of FIGS. 10 and 11. A housing 70 according to the prior art which is analogous to the inventive housing 60 is shown in FIG. 11.

Figure 10:
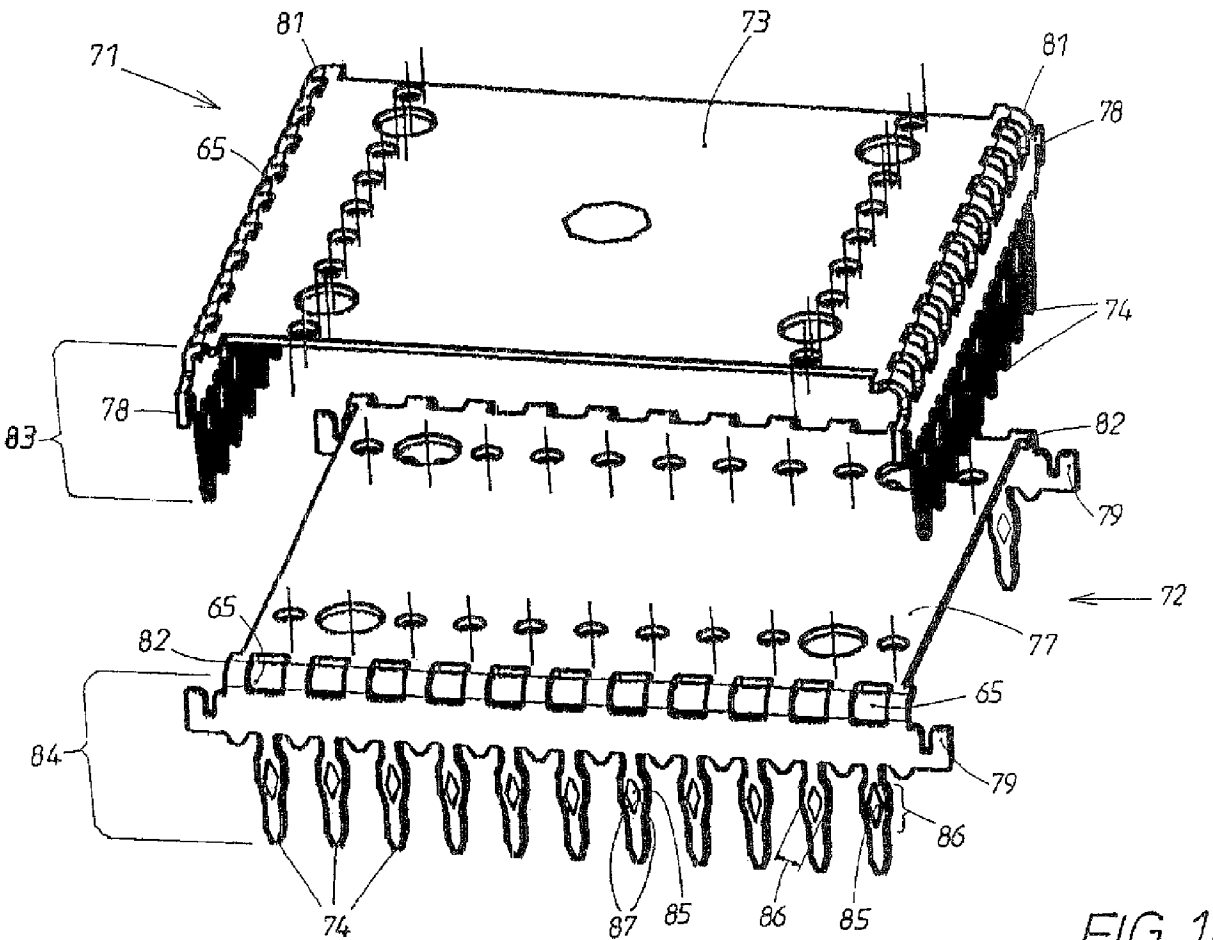
FIG. 10 PRIOR ART
Figure 11:
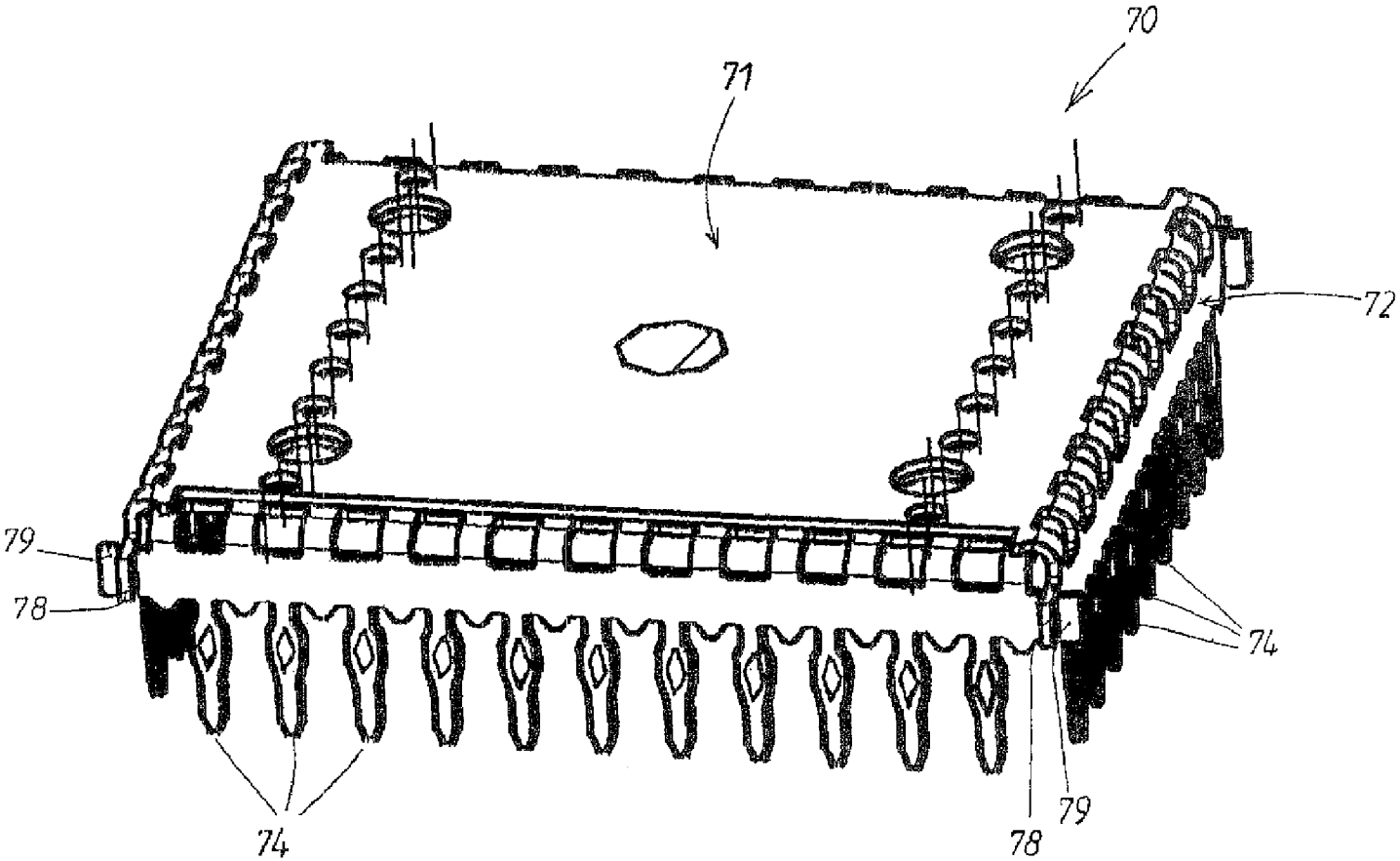
FIG. 11 PRIOR ART
Figure 12:
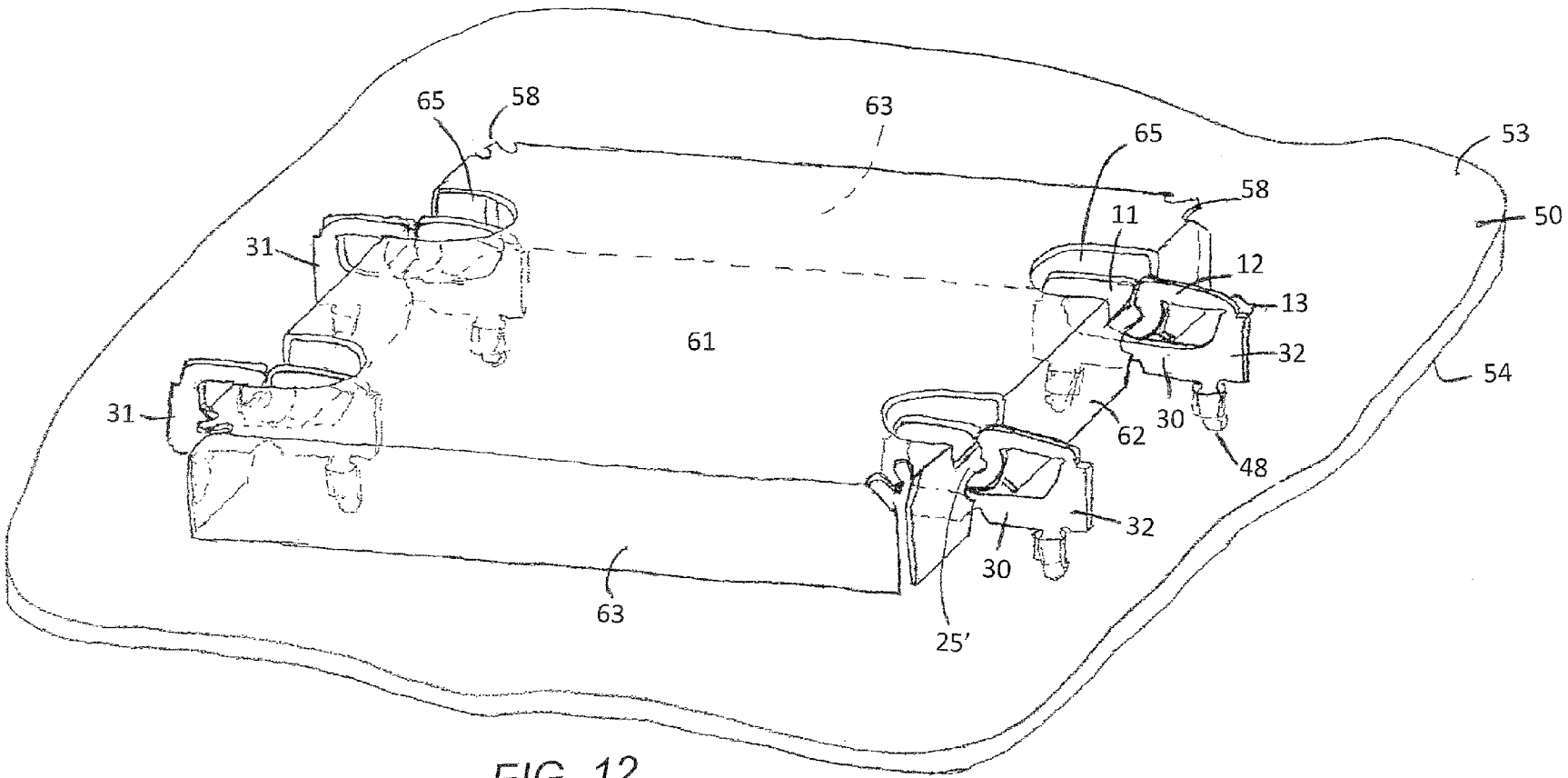
FIG. 12 shows a completed housing.

As can be seen from FIG. 10, this known housing consists of two housing parts 71, 72, which are similar to each other in design. Each housing part 71, 72 consists of its own cover plate 73, 77, which has bent-over edge zones 83, 84 at opposite ends. It therefore has a U-shaped profile in cross section. Housing part 71 thus has two bending edges 81, and housing part 72 has two bending edges 82, which supplement each other. The bending edges 81 of the first housing part 71 are oriented transversely, whereas the bending edges 82 of the second housing part 72 are oriented longitudinally. Thus the first housing part 71 has a U-shaped longitudinal profile, and the housing part 72 has a U-shaped transverse profile.

The outside areas of the edges zones 83, 84 are provided with an array of fastening elements 74, each of which consists of a plug-in part, which is designed to be inserted into a through-hole 51, similar to those shown in FIG. 8, in a circuit board 50. Each fastening element 74 has an expanded a section 86 of increased width, in which a cutout 85 is located. The expanded section is larger than the open diameter of the associated through-hole 51 in the circuit board 50. Elastic strips 87, which spread away each other, are thus formed on the long sides of the cutout 85. These strips are squeezed together during installation in the circuit board through-hole 51. Thus the fastening elements 74 are held in place in the circuit board through-holes 51. The two halves 71, 72 of the housing are not securely attached to the circuit board in this way. In the case of the inventive fastener 10.4, however, the installed position of FIG. 8 is secured by the grip of the latching projections 48.

It is true that, to facilitate the previously described bending along the edges 81, 82, an array of holes 65 is also provided in the known housing parts 71, 72 of FIG. 10; but, in contrast to the invention, these holes do not have a fastening function. The finished shield housing 70 of FIG. 11 is achieved by inserting the two housing parts 71, 72 of FIG. 10 into each other. The two housing parts 71, 72 are held together by complementary arms, which function as a locking tab 78 and an opposing locking tab 79. When the two housing parts are put together, the locking tab 78 and the opposing locking tab 79 interlock with each other in pairs during the course of a highly labor-intensive operation.

LIST OF REFERENCE NUMBERS

10.1 device for making clamping connections according to FIGS. 1-4
10.2 first variant of the device (FIG. 5)
10.3 second variant of the device (FIG. 6)
10.4 alternative device for fastening, fastener (FIGS. 7-9)
11 first clamping sidepiece (FIGS. 2, 7)—first part of a crimping tool
12 second clamping sidepiece (FIGS. 2, 7)—first part of a crimping tool
13 fixed end of sidepieces 11, 12, fixed end (FIGS. 2, 7)
14 elastic end of sidepieces 11, 12, spring end (FIGS. 2, 7)
14.0 resting position of 10.1, 10.3 (FIGS. 2, 3)
14.0' resting state of 10.4 (FIG. 7)
14.1 crimped state (FIG. 3)
14.1' crimped state of 10.4 (FIG. 8)
15 distance between 13 (FIGS. 2, 7)
16 distance between 14 (FIGS. 2, 7)
17.1 angle between 11, 12 in the resting state (FIG. 2)
17.1 angle between 11, 12 in the resting state (FIG. 7)
17.2 angle between 11, 12 in the crimped state (FIG. 3)
17.2' angle between 11, 12 in the crimped state, flattened position (FIG. 8)
18 thrust arrow of the exertion of pressure on 25 (FIGS. 2, 8)
19 pressing means, pushing tool for 25, second part of a crimping tool (FIGS. 2, 8)
20 loop of 10.1-10.3 (FIGS. 2, 5, 6, 7, 8)
21 first S-shaped transition of 20 to 11 (FIGS. 2, 7)
22 second S-shaped transition of 20 to 12 (FIGS. 2, 7)
23.1 loop opening in the resting state (FIG. 2)
23.1' loop opening in the resting state (FIG. 7)
23.2 loop opening in the crimped state (FIG. 3)
23.2' zero opening of 24' in the case of 10.4 (FIG. 8)
24 retaining area, interior of loop of 10.1 (FIG. 2)
24' retaining area, interior of loop of 10.4 (FIGS. 7, 8)
25 web, wire (FIGS. 2-6)
25' web, plate web (FIGS. 8, 9)
25.1' top narrow side
26 plane of symmetry between 11, 12 (FIGS. 2, 7)
27 S-curves, bending points (FIGS. 2, 3)
28 circumferential area of the contact of 25 (FIG. 3)
29 diameter of 25 (FIG. 3)
30 bus bar (FIGS. 1-6)
30' central piece of 10.4 (FIG. 7, 8)
31 first arm for 13 of 11 (FIGS. 2, 7)

32 first arm for 13 of 12 (FIGS. 2, 7)
33 bending point between 13 and 31 and between 13 and 32 (FIG. 2)
34 stamped-out area in 30 for 11, 12, 20, hollow profile (FIGS. 2-4, 7)
35 bottom area of 34 (FIGS. 5, 7)
36 thrust pad of 10.2 (FIG. 5)
37 arrow of the restoring force of 36 (FIG. 5)
38 compression distance between 14.0 and 14.1 (FIGS. 3, 6)
39 resilient pad for 42 (FIG. 6)
40 latching connection 10.3 (FIG. 6)
41 latching projection of 40 (FIG. 6)
42 opposing latching element for 41 of 40 (FIG. 6)
43 notch between 10.1 (FIG. 1)
44 head piece of 10.4 (FIGS. 7, 8)
45 foot piece of 10.4 (FIGS. 7, 8)
46 latching arm for 45 (FIGS. 7, 8)
47 pair of 46's (FIG. 7)
48 latching projection on 46 (FIGS. 7, 8)
49 support edge on 30' (FIG. 8)
50 base for 10.4, circuit board (FIG. 8)
51 through-hole in 50 (FIG. 8)
52 pair of through-holes (FIG. 8)
53 top side of 50 (FIG. 8)
54 bottom side of 50 (FIG. 8)
55 bending point of 30' (FIG. 7)
56 metal strip, strip material for 60 (FIG. 9)
57 edge strips of 56 (FIG. 9)
58 metal bridge between 60' and 57 (FIG. 9)
59 lateral protrusion in 24' (FIG. 7)
60 functional part, housing (FIG. 8)
60' stamped semi-finished product for 60 (FIG. 9)
61 cover plate of 60
62 transverse edge strip of 60, 60' (FIGS. 8, 9)
63 longitudinal edge strip of 60 (FIG. 9)
64 edge notch in 60, 60' (FIGS. 8, 9)
65 hole in 62 (FIGS. 8, 9)
66 lateral terminal edge of 62 (FIG. 9)
67 lateral terminal edge of 63 (FIG. 9)
68 first bending edge between 61, 62 (FIGS. 8, 9)
69 bottom elevation in 24' (FIG. 7)
70 shield housing according to the prior art (FIG. 11)
71 first housing part of 70 (FIG. 10)
72 second housing part of 70 (FIG. 10)
73 cover plate of 71 (FIG. 10)
74 plug-like fastening element on 71, 72 (FIGS. 10, 11)
75 crown of 20 (FIGS. 7, 8)
76 distance between 75, 35 of 10.4 (FIG. 7)
77 cover plate of 72 (FIG. 10)
78 locking tab on 71 (FIG. 10)
79 opposing locking tab on 72 (FIG. 10)
80 second bending edge between 61, 63 (FIG. 9)
81 transverse bending edge at 71 (FIG. 10)
82 longitudinal bending edge at 72 (FIG. 10)
83 edge zone of 71 (FIG. 10)
84 edge zone of 72 (FIG. 10)
85 cutout in 74 (FIG. 10)
86 expanded section of 74, flexible pressing-in zone (FIG. 10)
87 pair of elastic strips in 86 (FIG. 10)
88 inner half of 10.4 in 90 (FIG. 8)
89 outer half of 10.4 (FIG. 8)
90 interior of housing 60 (FIG. 8)

The invention claimed is:

1. A device (10.1, 10.2, 10.3, 10.4) for electrically or mechanically connecting a web (25, 25'), with a pair of sidepieces (11, 12), one end (13) of each sidepiece being fixed, thus forming a fixed end (13);

whereas the other ends of the sidepieces are able to move elastically with respect to each other and form spring ends (14), which serve to connect the web (25, 25');

with a U-shaped loop (20), which connects the two spring ends (14) of the pair of sidepieces (11, 12) integrally together;

where the web (25, 25') is introduced into an opening (23.1, 23.1') of the U-shaped loop (20); and where the loop (20) is deformed during the introduction of the web (25, 25'), wherein a pressing means (19) functions as an active part of a crimping tool for introducing the web (25, 25'), conveys the web (25, 25') into an interior (24, 24') of the loop, and exerts pressure (18) on the two spring ends of the pair of sidepieces (11, 12); where the pair of sidepieces (11, 12) represents a passive part of the crimping tool, because the opening (23, 23') in the loop is narrowed down (23', 23") by the pressing means (19) behind the inserted web (25, 25'); and where after a crimping operation (14.1, 14.1'), the deformed loop (20) wraps around more than half a peripheral portion (28) of the web (25, 25').

2. A device according to claim 1, wherein, in a crimped state (14.1, 14.1'), the open width of the opening (23.2, 23.2') in the loop is smaller than a diameter (29) or a cross section of the web (25, 25') held in the opening.

3. A device according to claim 1, wherein the device (10.1; 10.4) is an integral part of a plate-shaped carrier (30; 30') and is made as a stamped product out of sheet metal; and where stamping produces a closed, ring-shaped, hollow profile along an edge of the plate-shaped carrier (30; 30'), which forms a gap between the pair of sidepieces (11, 12) with the loop (20) and the carrier (30; 30').

4. A device according to claim 3, wherein the fixed ends (13) of the two clamping sidepieces (11, 12) are connected to the carrier (30, 30') by way of bending points (33).

5. A device according to claim 1, wherein the web consists of a current-carrying electrical conductor (25), and in that the electrical conductor is a wire, which is perpendicular to a plane of the pair of sidepieces (11, 12) and is preferably free of insulation.

6. A device according to claim 5, wherein the carrier (30) is a bus bar, on which a plurality of pairs of sidepieces (11, 12) is seated for a plurality of wires (25).

7. A device according to claim 1, wherein the device (10.2) comprises a resilient pad (39), against which the loop (20) is pressed in a crimped state, and where in the crimped state, the pad (39) exerts a restoring force (37) on the loop (20) and on the web (25) held in the loop.

8. A device (10.3) according to claim 7, wherein the device (10.3) is provided with a latching connection (40), which is engaged in the crimped state (14.1) and disengaged in a resting state (14.0').

9. A device (10.3) according to claim 8, wherein, in the crimped state (14.1), the engaged latching connection (40) exerts additional clamping force on the web (25) held in the loop (20).

10. A device (10.3) according to claim 8, wherein the latching connection consists of at least one projection (41) in a circumferential area of the loop (20) and at least one opposing latching element (42) in the pad (39), which is installed in a stationary position.

11. A device (10.4) according to claim 1, and further comprising a base (50) and a functional part (60), wherein the web (25') is on the functional part (60); where the pair of clamping sidepieces (11, 12) forms a head piece (44) of the device (10.4), the device has a foot piece (45) attached to the base (50), and the loop (20) extends around the web (25') of the functional part (60) in a crimped state (14.1') so as to fasten the functional part (60) to the base (50).

12. A device (10.4) according to claim 11, wherein, in the crimped state (14.1'), a crown (75) of the loop (20) comes to rest against a bottom area (35) of the central piece (30').

13. A device (10.4) according to claim 11, wherein the functional part (60) consists of a housing (60), which is formed out of strip material (56); where the housing (60) consists of a cover plate (61) with edge strips (62, 63), which are bent over (68, 80) all the way around; and where in a transition area between the cover plate (61) and one of the edge strips (62), a hole (65) is stamped out, which produces the web (25') on an outward-facing side of the hole.

14. A device (10.4) according to claim 13, wherein, in the crimped state (14.1'), a sidepiece (11) of the pair of sidepieces (11, 12) engages in the hole (65) in the cover plate (61).

15. A device (10.4) according to claim 13, wherein a notch (64) is provided in the edge strip (62) opposite the hole (65), a crown area of the loop and a carrier (30') of the device (10.4) extending through the notch in the crimped state (14.1').

16. A device (10.4) according to claim 11, wherein the foot piece (45) has a pair (47) of latching arms (46) serving to attach the fastener to the base (50), the latching arms (46) extend through a pair (52) of through-holes (51) in the base (50).

17. A device (10.4) according to claim 16, wherein the base consists of a circuit board (50), and the latching arms (46) are provided with latching projections (48), which, in the crimped state, grip a bottom side (54) of the circuit board (50).

18. A device (10.4) according to claim 17, wherein the two latching arms (46) and their latching projections (48) are designed as mirror images of each other with respect to a plane of symmetry (26) of the device (10.4); and where the plane of symmetry (26) also determines a mirror-image arrangement of the two sidepieces (11, 12) and the loop (20) located between them.

19. A device (10.4) according to claim 18, wherein, in the crimped state (14.1'), one half (88) of the device (10.4) is located in the interior (90) of the functional part (60), whereas another half (89) is located outside the functional part (60).

20. A device (10.4) according to claim 11, wherein the functional part (60) consists of a cover plate (61), which comprises a hole (65) in an edge strip (62); where the hole (65) is bounded by a plate web (25') on an outward-facing side of the hole; and wherein the crimped state (14.1'), the plate web)(25') is gripped by the loop (20).

21. A device (10.4) according to claim 11, wherein an interior portion (24') of the loop has a distinct profile (59, 69).

22. A device (10.4) according to claim 21, wherein an internal profile of the loop (20) consists of two opposing protrusions (59) and a protrusion (69) on a bottom in an area of a crown (75) of the loop; and where in the crimped state (14.1'), the protrusions (59, 69) clamp the plate web.

23. A device (10.4) according to claim 11, wherein, in the crimped state (14.1'), the pair of sidepieces (11', 12') are essentially flattened out (17.2) relative to the functional part.

24. A device (10.4) according to claim 23, wherein, in the crimped state (17.1'), the opening (23.2') between the spring ends (14) of the pair of sidepieces (11, 12) is closed.

25. A device (10.4) according to claim 23, wherein, in the crimped state (14.1), the spring ends (14) of the pair of sidepieces (11, 12) are pressed against a top narrow side of the plate web (25').

* * * * *